US006247971B1

(12) United States Patent
Lim

(10) Patent No.: US 6,247,971 B1
(45) **Date of Patent: *Jun. 19, 2001**

(54) CONNECTOR COVER WITH INTEGRAL TERMINATOR AND INSULATION DISPLACING CONTACTS

(76) Inventor: Gunsang George Lim, 8695 Rhonda Cir. South, Cordova, TN (US) 38018

( * ) Notice: Subject to any disclaimer, the term of this patent is extended or adjusted under 35 U.S.C. 154(b) by 0 days.

This patent is subject to a terminal disclaimer.

(21) Appl. No.: 09/360,221

(22) Filed: Jul. 23, 1999

(Under 37 CFR 1.47)

Related U.S. Application Data

(62) Division of application No. 08/789,436, filed on Jan. 27, 1997, now Pat. No. 6,109,970.

(51) Int. Cl.[7] ..... H01R 13/66
(52) U.S. Cl. ..... 439/620
(58) Field of Search ..... 439/76.1, 620, 439/404, 405

(56) References Cited

U.S. PATENT DOCUMENTS

| | | | |
|---|---|---|---|
| 3,800,097 | 3/1974 | Maruscak et al. . | |
| 4,401,351 | 8/1983 | Record . | |
| 4,410,229 | 10/1983 | Stephenson . | |
| 4,586,769 | 5/1986 | Tengler et al. . | |
| 4,610,493 | 9/1986 | Masek . | |
| 4,643,497 | 2/1987 | Oelsch . | |
| 4,838,814 | 6/1989 | Takai et al. . | |
| 4,857,002 | 8/1989 | Jensen et al. . | |
| 4,881,092 | 11/1989 | Papa . | |
| 4,932,873 * | 6/1990 | La Shier | 439/77 |
| 4,932,892 | 6/1990 | Hatch . | |
| 4,954,089 | 9/1990 | Jensen et al. . | |
| 4,983,130 | 1/1991 | Caveney et al. . | |
| 5,108,294 | 4/1992 | Marsh et al. . | |
| 5,387,131 | 2/1995 | Foreman . | |
| 5,472,348 | 12/1995 | Daly et al. . | |
| 5,572,840 | 11/1996 | Wu et al. . | |
| 5,580,271 | 12/1996 | Buchheister, Jr. . | |
| 5,827,074 | 10/1998 | Gatti . | |

OTHER PUBLICATIONS

Hardware, pp. 455,457, undated.
Internet, comp.periphs.scsi FAQ, Nov. 21, 1996.

* cited by examiner

*Primary Examiner*—Neil Abrams
(74) *Attorney, Agent, or Firm*—Hoffmann & Baron, LLP

(57) ABSTRACT

A terminator assembly for multiconductor cables is formed to replace the cover of an insulation displacement connector. The terminator assembly includes terminator circuitry and insulation displacement contacts which provide an electrical interface between the terminator circuitry and multiconductor cable. The terminator assembly is designed to replace the cover of a standard insulation displacement connector and eliminate the need for a separate terminator assembly and cable extender. The terminator circuitry and insulation displacement contacts are supported by a cover housing which provides the required mechanical interface to a standard insulation displacement connector base.

5 Claims, 4 Drawing Sheets

CONNECTOR COVER WITH INTEGRAL TERMINATOR AND INSULATION DISPLACING CONTACTS

The present application is a divisional of U.S. patent application Ser. No. 08/789,436 filed Jan. 27, 1997, now U.S. Pat. No. 6,109,970, issued Aug. 29, 2000.

FIELD OF THE INVENTION

This invention relates to multiconductor cable assemblies. More particularly relates to a cable terminator which is integral to a cover structure suitable for attachment to a standard insulation displacement connector base used in forming a terminated multiconductor cable assembly.

BACKGROUND OF THE INVENTION

It is well known in the prior art that high speed switching circuits need to be properly terminated in order to ensure proper performance. By terminating such circuits, signal reflections which would create voltage standing waves and result in waveform distortion may be minimized. The suppression of voltage standing waves has been a long standing problem typically experienced in radio frequency circuits. However, as modem computer circuits feature increased operating speeds, proper termination of these computer circuits is now also critical.

The most difficult circuitry to terminate is that which is interconnected by a cable assembly. This is especially true where a number of circuits may be interconnected by a single cable. Such an application is found in the Small Computer System Interface (SCSI) bus system. The SCSI bus standard sets forth a multiconductor bus structure which requires termination at both the signal source and signal destination. In addition to providing the desired impedance matching, the terminator in a SCSI bus assists in establishing the required voltage at the time of signal negation and establishing the required current lead at the time of signal assertion. Several attempts have been made to terminate such circuitry in the prior art.

For example, U.S. Pat. No. 4,610,493 to Masek ('493 patent) illustrates a terminator for multiconductor ribbon cable. The terminator of the '493 patent includes a base, a terminator circuit and a cover. The base and cover snap together to depress insulation displacement contacts from the terminator circuit into the ribbon cable. This approach requires a full mechanical assembly which is separate from a connector which interconnects the circuits. Further, as the '493 patent is directed to a separate terminator assembly, the circuits are necessarily terminated at a point physically removed from the actual interconnection. This type of terminator assembly is illustrated in FIG. 1. A cable assembly 1 includes plural connectors 2 terminated to cable 3 in longitudinal spaced-apart succession. A terminator assembly 4 is shown terminating an end extent of a cable extension 6. The separation introduced by the cable extension 6, however small, allows a voltage standing wave to form.

A further example of a terminator device known in the prior art is illustrated in U.S. Pat. No. 4,932,873 to La Shier ('873 patent). The '873 patent describes a terminator assembly suitable for use in multiconductor ribbon cable. The '873 patent discloses a terminator assembly formed using a standard dual in-line package (DIP) carrier having insulation displacement contacts as part of the assembly. The DIP carrier forms a base to support terminator circuit components. Top and bottom covers are included which snap the assembly together forcing the insulation displacement contacts of the terminator assembly into the cable to be terminated. The '873 patent is formed as an assembly which is separate from any connector on the cable. Therefore, this device has similar disadvantages to that of the '493 patent.

U.S. Pat. 4,954,089 to Jensen et al. ('089 patent) discloses a terminator which is formed as an interconnect device having both male and female connections. This device is suitable for terminating cables which include a separate connector assembly which mates with the terminator. While the '089 device allows connections to be terminated in close proximity to the point of interconnection, the '089 device requires a separate mechanical structure which has the equivalent complexity of two connectors. As the '089 device is a separate assembly from the connector itself, it necessarily adds additional cost and size to the terminated cable assembly.

Another terminator design is disclosed in U.S. Pat. No. 5,472,348 to Daly et al. ('348 patent). The device in the '348 patent is a plugable male terminator assembly which includes male connector pins, a terminator circuit connected to these pins and a housing enclosing the pins and circuitry. The terminator of the '348 patent is designed to mate with the female connector structure which would be mounted on a multiconductor cable to be terminated. The device in the '348 patent has the disadvantages of the '089 patent in that it requires a full assembly which is separate from the cable connector itself. The '348 patent also shares the disadvantages of the '493 and '873 patents, in that this device will typically be mounted a distance away from the circuitry which is to be terminated.

SUMMARY OF THE INVENTION

It is an object of the present invention to provide a cable terminator which will provide enhanced performance by terminating the circuits at a location proximate to the last connector.

It is another object of the present invention to provide a terminator which replaces the cover of an IDC connector assembly to reduce the cost of the terminator assembly.

It is yet another object of the present invention to provide a terminator which features reduced size by forming the terminator to replace the cover of an IDC connector assembly.

It is a further object of the present invention to simplify the assembly of a computer cable system by integrating a terminator within the cover of an IDC connector.

In accordance with one form of the present invention, a terminator assembly is formed as a cover assembly for a standard insulation displacement connector. The terminator assembly includes a terminator circuit which is operatively coupled to plurality of insulation displacement connector contacts. The insulation displacement connector contacts are located to interleave with the corresponding insulation displacement contacts in the base of the insulation displacement connector.

The terminator circuit and insulation displacement connector contacts are interposed within a terminator housing which is designed to interface and snap together with a standard insulation displacement contact connector base. This allows the terminator circuit of the present invention to be used in place of a standard insulation displacement connector cover and terminate the circuitry of the cable directly at the point of interconnection. The terminator of the present invention utilizes an insulation displacement connector base as part of the assembly. Therefore, the terminator of the present invention allows for termination of multiconductor cables with fewer mechanical components and resulting lower costs than those terminator assemblies of the prior art.

DETAILED DESCRIPTION OF THE PREFERRED EMBODIMENTS

Figure 2:
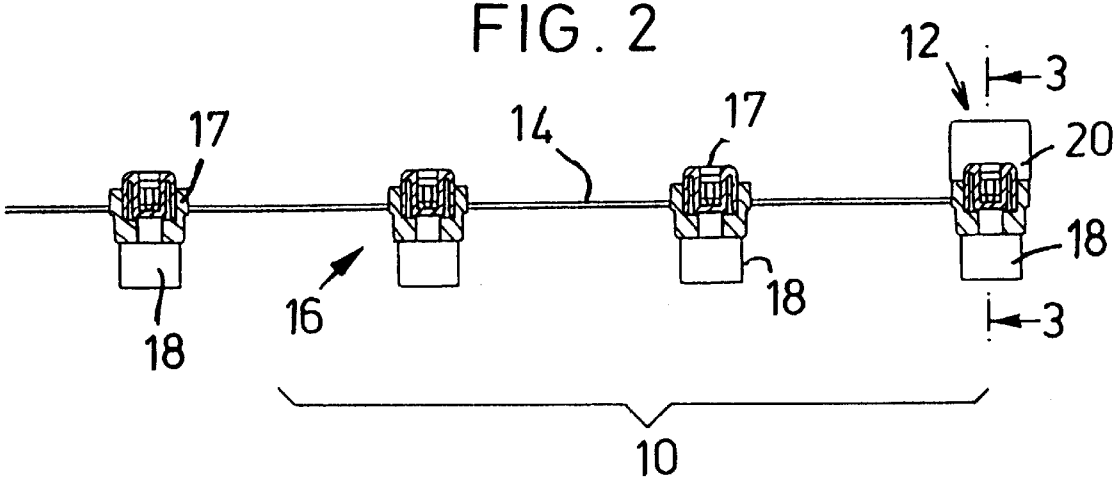
FIG. 2 is a multi-conductor cable assembly employing a terminator connector of the present invention.
Figure 6:
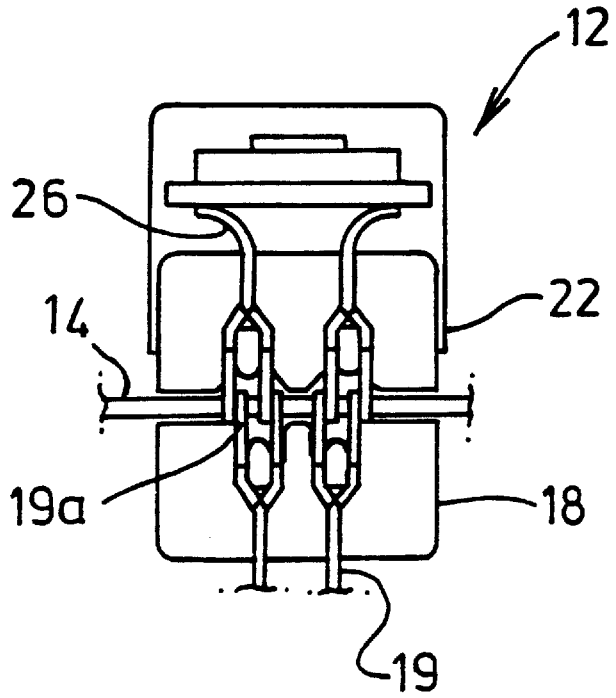
FIG. 6 is a cross-sectional view of the terminator connector of the present invention includes the terminator assembly, an insulation displacement connector base and cable structure.

FIG. 2 illustrates a cable assembly 10 which is formed using a terminator assembly 12 of the present invention. In this illustration, multiconnector ribbon cable assembly 10 is formed using multiconductor ribbon cable 14 and a series of conventional insulation displacement connectors 16. Each connector 16 includes an elongate electrically insulative base 18 supporting plural insulation displacing electrical contacts 19 (FIG. 6). A cover 17 is designed to cooperate with and overlie the base 18. Each connector 16 is terminated to cable 14 at spaced locations therealong in conventional fashion with the cable 14 residing between the cover 17 and base 18. Upon placement of the cover 17 onto base 18, in conventional fashion well-known in the connector art, insulation displacement portions 19*a* of the contacts 19, are forced through the insulation of the cable 14 and into conductive engagement with the conductors supported therein.

Figure 1:
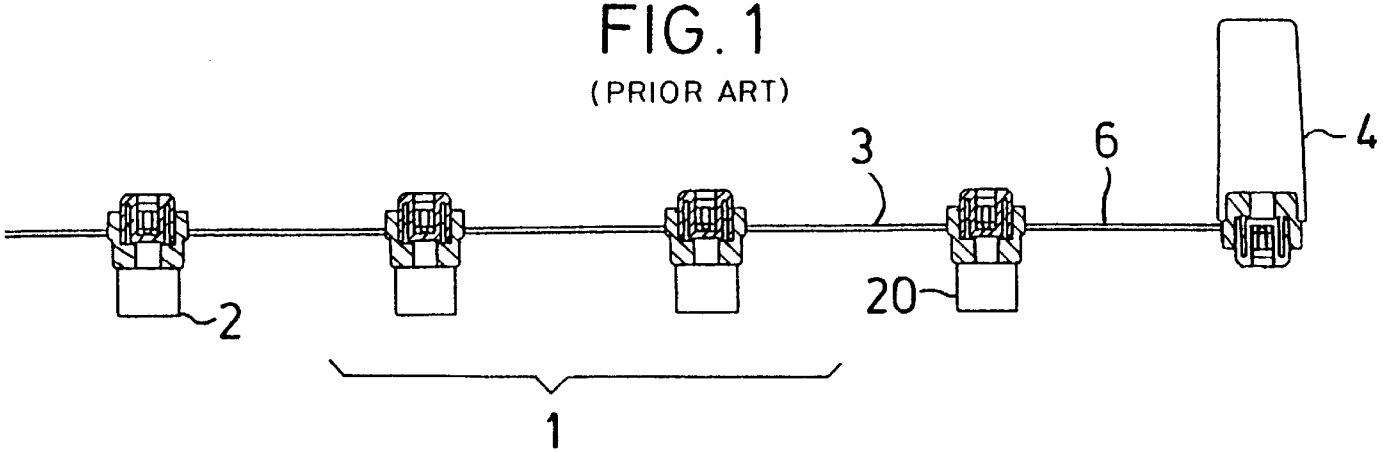
FIG. 1 (PRIOR ART)
FIG. 1 shows a multi-conductor cable assembly terminated with a plurality of electrical connectors and a prior art terminator structure.

A last connector 20 in cable assembly 10 includes a base 18 as described above and a terminator assembly 12 formed in accordance with the present invention in place of conventional cover 17. The terminator assembly 12 of the present invention functions both as the cover for the base 18 as well as provides the electrical function of the terminator assembly 4 shown in FIG. 1. In this manner, the cable assembly 10 no longer requires the cable extension 6 and additional terminator assembly 8 as was required in prior art cable assemblies.

Figure 3:
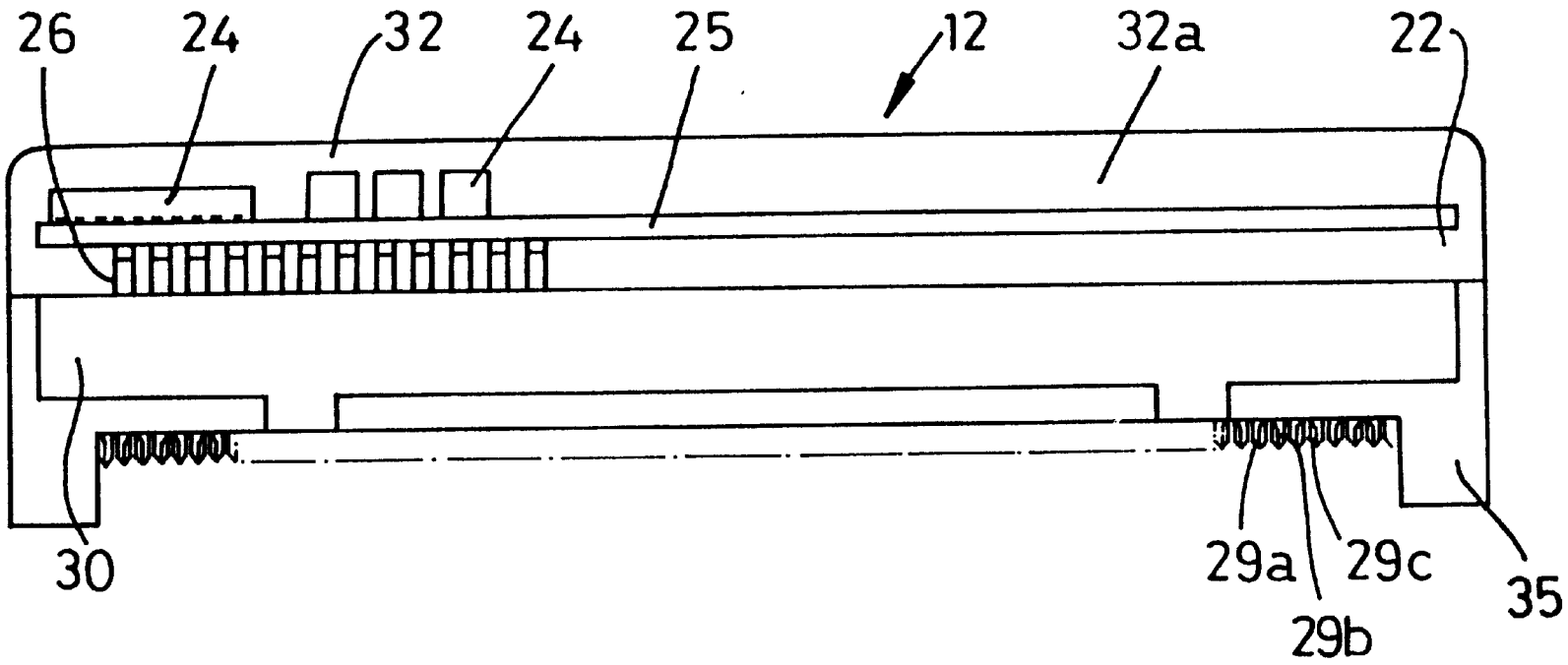
FIG. 3 is a longitudinal cross-sectional view of the terminator assembly of the terminator connector of FIG. 2.
Figure 4:
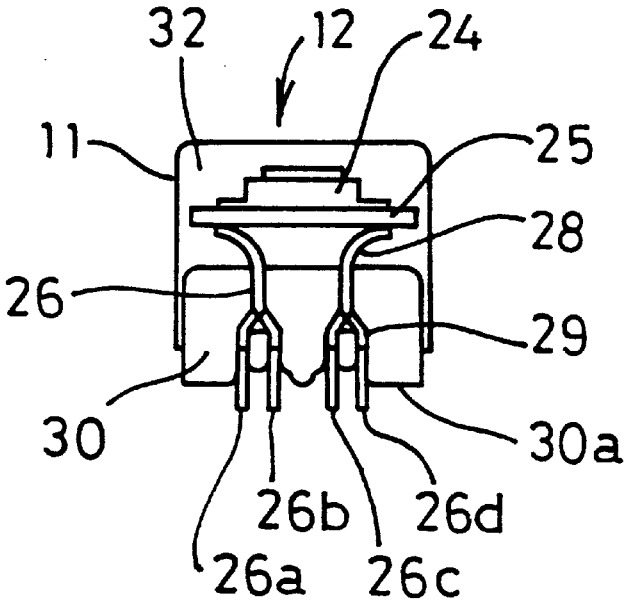
FIG. 4 is a cross-sectional end view of the terminator assembly of FIG. 3.

A first embodiment of the terminator assembly 12 formed in accordance with the present invention is shown in further detail in FIGS. 3 and 4. The terminator assembly 12 includes an elongate insulated housing 22 generally in the shape of a connector cover which supports termination circuitry 24.

The termination circuitry 24 may take the form of any termination circuitry known in the prior art, either active or passive. For terminators formed for use with SCSI cables, the termination circuitry 24 must comply with one of the SCSI bus standards established by the American National Standards Institute, such as: SCSI-1, ANSI X 3.131-1986; SCSI-2, ANSI X3.131-199X; and SCSI-3, ANSI X3T9.2/91-0/0R4 (working draft); which are incorporated by reference herein.

In order to facilitate the small physical packaging requirements of the present invention, surface mount technology is employed to form such circuitry. The smallest body type components, which offer suitable component parameter values and power dissipation, are typically employed. In a preferred embodiment, passive components, such as resistors and capacitors, will have the physical form of the 0402 standard (approximately 40 mils long, 20 mils wide). Active devices, such as integrated circuits, will preferably have fine pitch surface mount lead spacing of 25 mils or less. The termination circuitry 24 is mounted on a printed circuit substrate 25 which provides all required electrical interconnections and mechanical support for the termination circuitry 24.

The terminator assembly 12 of the present invention further includes a plurality of electrically conductive insulation displacement contacts 26. Each contact 24 includes a circuitry interface end 28 and an insulation displacement end 29. The insulation displacement end 29 of each of the contacts 26 is formed having a pair of spaced apart tines 29*a* and 29*b* defining therebetween a conductor slot 29*c*. The tines 29*a* and 29*b* are designed for piercing the insulation of the cable 14 so as to establish electrical connection with a conductor supported in slot 29*c*. The circuitry interface end 28 of the contacts 26 are operatively coupled to the termination circuitry 24. In this manner, when the insulation displacement end 29 of the contact 26 is inserted into the cable 14, an electrical connection is established between a conductor within cable 14 and the termination circuitry 24. Each of the plurality of insulation displacement contacts 26 are arranged such that they align with an individual conductor within the multiconductor ribbon cable 14.

Figure 4A:
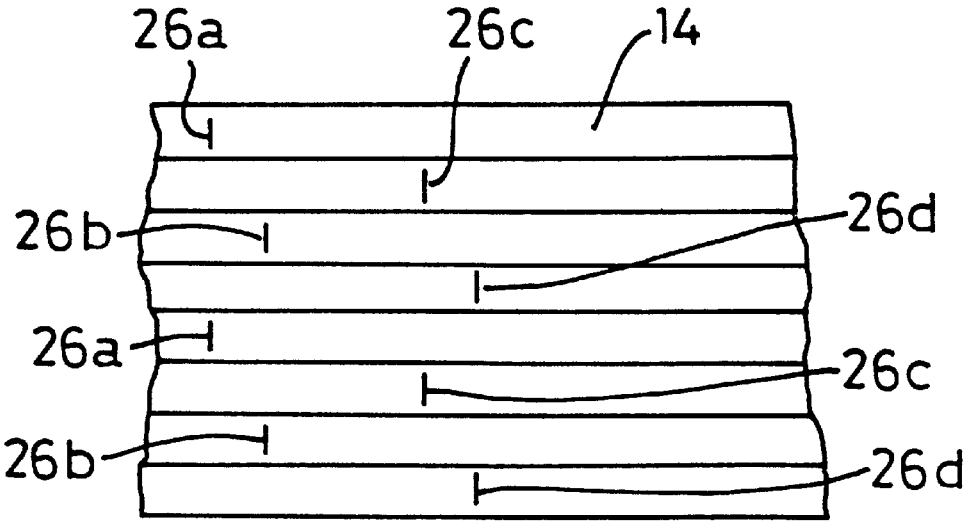
FIG. 4A is a top view of a multiconductor cable showing the alignment of the terminator insulation displacement contacts with the conductors of the multiconnector cable.

The insulation displacement contacts 26 as well as termination circuitry 24, are supported in housing 22. The housing 22 is formed of a suitably insulative material, and includes a housing base 30 and a housing shroud 32. Base 30 supports the insulation displacement contacts 24. In the present embodiment, the insulation displacement ends 29 of the contacts 24 are arranged to form four rows 26*a–d* extending from one end 30*a* of housing base 30. FIG. 4A shows a typical arrangement of the contacts 26 interfacing with the cable 14. This arrangement provides separation between adjacent contacts and reduces the potential for a short circuit occurring between contacts.

The housing shroud 32 is formed as a shell with a length and width substantially equal to that of housing base 30. Housing shroud 32 includes an interior cavity 32*a*. The depth of interior cavity 32*a* is selected to accommodate the termination circuitry 24 and contacts 26 when the shroud 32 is positioned over the housing base 30. The shroud 32 and base 30 are each formed to mutually engage and cover the terminator circuitry 24, printed circuit substrate 25 and contacts 26. The shroud 32 may be affixed to the housing base 30 by any method known in the prior art including adhesion, mechanical interlocks and mechanical interference fitting. As an alternative, the shroud 32 may be formed by injection molding a non-conductive material about housing base 30, contacts 26, printed circuit substrate 25, and termination circuitry 24 to form terminator assembly 12.

Figure 5:
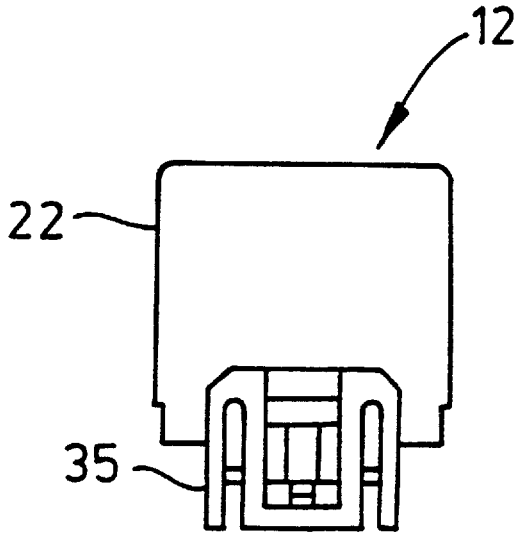
FIG. 5 is an end view of the housing of the terminator assembly formed in accordance with the present invention.

Referring additionally to FIG. 5, housing 22 further includes depending mechanical latches 35 at each end thereof. The mechanical latches 35, are designed to cooperate with a standard connector base 18. Therefore, the specific design of latches 35 is selected to be complementary to standard mechanical latches formed on conventional connector covers 17 being replaced by the terminator assembly 12. In this way, the terminator assembly 12 may be used in place of a connector cover 17 to facilitate the connection and termination of the last insulation displacement connector base 18 on a cable assembly 10.

FIG. 6 illustrates a cross-sectional view of the terminator assembly 12 shown in cooperation with an insulation displacement connector base 18 and multiconductor ribbon cable 14. This view illustrates the preferred alignment of the insulation displacement contacts 26 of the terminator assembly 12 interleaving with the contacts 19 of the connector base 18. When the terminator assembly 12 is engaged on the cable 14, the insulation displacement contacts 26 of the terminator assembly 12 and contacts 19 of connector base 18 are forced into engagement with the conductors of the cable 14. This provides an electrical interface between the cable 14, the connector base 18 and the termination circuitry 24.

Accordingly, the terminator of the present invention may be formed for use with any standard IDC connector base. An illustrative, nonexclusive list of such connector bases include: dual row connectors such as the DD-50 p (2 rows, 25 pins per row); DB-25; DB-9; DD-50 SA; 50 pin MINI-Micro D; Centronics; and wide SCSI-3 P 68 pin connectors. Adapting the terminator to each of these connectors requires matching the physical profile, contact alignment and mechanical interlock of the terminator to the selected connector base. The principles outlined above do not change for differing connector types.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A terminator connector assembly suitable for terminating signals presented at connections within a multiconductor ribbon cable, said terminator connector assembly comprising:

an insulation displacement connector base for mechanically and electrically terminating said multiconnector ribbon cable;

a terminator circuit;

a plurality of electrical contacts, each contact having a first and second end, each said first end being electrically coupled to said terminator circuit, each said second end having an insulation displacement portion for engagement with a conductor of said multiconductor ribbon cable; and a housing, said housing supporting and enclosing said terminator circuit and said plurality of contacts, said housing being formed to mechanically interface with the insulation displacement connector base and form a cover therefor, whereby upon said mechanical interface of said housing and the insulation displacement connector base with the multiconductor cable interposed therebetween said electrical contacts engage with said conductors of said cable to provide electrical coupling between said conductors and the terminator circuit.

2. A terminator connector assembly as defined by claim 1, wherein the insulation displacement connector base and terminator circuit comply with a SCSI bus standard.

3. A terminator connector assembly as defined by claim 1, wherein the housing is formed to interface with a dual row, fifty contact connector base suitable for use with 0.025 inch centerline ribbon cable and the terminator circuit complies with a SCSI bus standard.

4. A terminator connector assembly as defined by claim 1, wherein the housing is formed to interface with a dual row, sixty-eight contact connector base suitable for use with 0.025 inch centerline ribbon cable and the terminator circuit complies with a SCSI bus standard.

5. A terminator connector assembly of claim 1 wherein said connector base is an insulative member supporting a plurality of base contacts for terminating said multiconductor ribbon cable.

* * * * *